US008002494B2

(12) United States Patent
Ciccarello

(10) Patent No.: US 8,002,494 B2
(45) Date of Patent: Aug. 23, 2011

(54) PAVING STONE AND METHOD

(75) Inventor: Charles Ciccarello, Brossard (CA)

(73) Assignee: Techo-Bloc Inc., St. Hubert, Quebec (CA)

( * ) Notice: Subject to any disclaimer, the term of this patent is extended or adjusted under 35 U.S.C. 154(b) by 120 days.

(21) Appl. No.: 12/488,660

(22) Filed: Jun. 22, 2009

(65) Prior Publication Data

US 2010/0322709 A1 Dec. 23, 2010

(51) Int. Cl.
*E01C 5/00* (2006.01)

(52) U.S. Cl. ..... 404/42; 404/34; 404/36; 404/39; 404/41

(58) Field of Classification Search ..... 404/34–42
See application file for complete search history.

(56) References Cited

U.S. PATENT DOCUMENTS

| | | | | | |
|---|---|---|---|---|---|
| 3,494,266 | A * | 2/1970 | Baumberger | 404/41 |
| 4,773,790 | A * | 9/1988 | Hagenah | 404/41 |
| 5,333,430 | A * | 8/1994 | Vidal | 52/311.2 |
| 5,348,417 | A * | 9/1994 | Scheiwiller | 404/41 |
| 5,645,369 | A * | 7/1997 | Geiger | 404/34 |
| 5,884,445 | A * | 3/1999 | Woolford | 52/311.2 |
| D429,343 | S * | 8/2000 | Milot | D25/113 |
| 6,168,347 | B1 * | 1/2001 | Milot et al. | 404/34 |
| 6,881,463 | B2 * | 4/2005 | Riccobene | 428/44 |
| D537,501 | S * | 2/2007 | Riccobene | D25/113 |
| D543,642 | S * | 5/2007 | Castonguay et al. | D25/113 |
| D602,173 | S * | 10/2009 | Thomassen | D25/113 |
| D603,975 | S * | 11/2009 | Thomassen | D25/113 |
| D606,210 | S * | 12/2009 | Thomassen | D25/113 |
| 2004/0045248 | A1 * | 3/2004 | Drost | 52/604 |
| 2007/0217865 | A1 | 9/2007 | Castonguay et al. | |
| 2008/0095577 | A1 * | 4/2008 | Brun | 404/42 |

* cited by examiner

*Primary Examiner* — Raymond W Addie
(74) *Attorney, Agent, or Firm* — Norton Rose OR LLP

(57) ABSTRACT

A concrete cast stone resembling a flagstone for use with other ones of the concrete cast stones for covering a surface. The concrete cast stone comprising a body having a peripheral contour of non-repetitive jagged shape for interlocking engagement of a plurality of the concrete cast stone. The peripheral contour defining a distinguishable orientation with interlocking side sections and part-interlocking side sections such that said concrete cast stones placed side-by-side interlock by one or a combination of (1) matching the interlocking side sections in a linear arrangement of the concrete cast stones, and (2) matching the part-interlocking side sections in a herringbone arrangement. A method for assembling the concrete cast stone is also provided.

12 Claims, 5 Drawing Sheets

PAVING STONE AND METHOD

FIELD OF THE APPLICATION

The present application relates to paving stones, and more particularly to a paving stone for use in an interlocking system of pre-cast paving stones.

BACKGROUND OF THE ART

Pre-cast paving stones of concrete are commonly used to lay out pavements, to define patios, driveways, walkways. When compared to natural stones, pre-cast paving stones are relatively inexpensive to make, and provide numerous advantages. The paving stones are for instance pre-cast with a flat surface, and generally uniform thickness. Accordingly, when they are laid out on compacted ground, an assembly of pre-cast paving stones forms a uniform flat surface. Moreover, the paving stones are usually sized for ergonomic handling.

The challenge in designing a pre-cast paving stone is to make it look like natural stones once laid out. Some paving stones generally have polygonal geometries, which geometry results in the paving stone lay out producing repetitive patterns. In instances, some paving stones have been designed to look like natural stones and consequently may have an irregular contour. However, such stones may be difficult to assemble, by a lack of distinguishable orientation due to their irregular contour. US Patent Application Publication no. 2007/0217865, by Castonguay et al. shows a flagstone having a generally hexagonal shape. Referring to FIG. 4 thereof, an arrangement of flagstone lay-out is illustrated. Due to the repetitive contour formations of the flagstone of Castonguay et al., the assembly of these stones may be difficult as some of the formations look alike. Moreover, the compact shape of these flagstones and relatively straight edges results in their lay-out being repetitive. It is therefore desirable to produce a pre-cast paving stone that can simulate natural flagstone and which is easy to install while having an irregular contour with non-repetitive projections and depressions.

Another disadvantage of the prior art stone is that its contour shape does not lend itself to forming paved areas with outer edges having generally well defined demarcations, such as when laying an assembly of such stones against a straight edge or when constructing pathways with well defined edges.

SUMMARY OF THE APPLICATION

It is therefore an aim of the present application to provide a novel paving stone, resembling a flagstone, and method for assembling same.

In accordance with a broad aspect of the present invention there is provided a concrete cast stone for use with other ones of the concrete cast stones for covering a surface. The concrete cast stone comprises an elongated shaped body having a longitudinal axis with the body tapering along the axis from opposed sides thereof to define a smaller tapering end resulting in a distinguishable orientation for the stone. The body has a peripheral contour of non-repetitive jagged shape for interlocking engagement of a plurality of the concrete cast stone. The peripheral contour has interlocking side sections and part-interlocking side sections such that the concrete cast stones placed side-by-side interlock by one or a combination of (1) matching the interlocking side sections in a linear arrangement of the concrete cast stones wherein the stones are aligned along their longitudinal axis, and (2) matching some of the concrete cast stones with their longitudinal axis transverse to the linear arrangement and partly interlocked with each other and the concrete cast stones of the linear arrangement to form a herringbone arrangement. The body has three pairs of side sections with (a) the side sections of different pairs being different from one another, (b) the side sections of a same pair generally being translated images of one another and being on opposite sides of the longitudinal axis of the body to define interlocking profiles, such that the concrete cast stones placed side-by-side interlock by matching equivalent pairs of side sections in the linear arrangement of the concrete cast stones, and (c) the adjacent side sections of a first pair and of a second pair of one of the concrete cast stone being an interlocking image of the adjacent combined side sections of the second pair and of a third pair of two of the stones, such that when a first row is defined by interlocking the concrete cast stones by the first pair, and a second row is defined by interlocking the concrete cast stones by the third pair, the first row and the second row are interlockable by the adjacent combined side sections of the first row interlocking with the adjacent side sections of the second row in the herringbone arrangement of the concrete cast stones.

DESCRIPTION OF THE PREFERRED EMBODIMENTS

Figure 1:
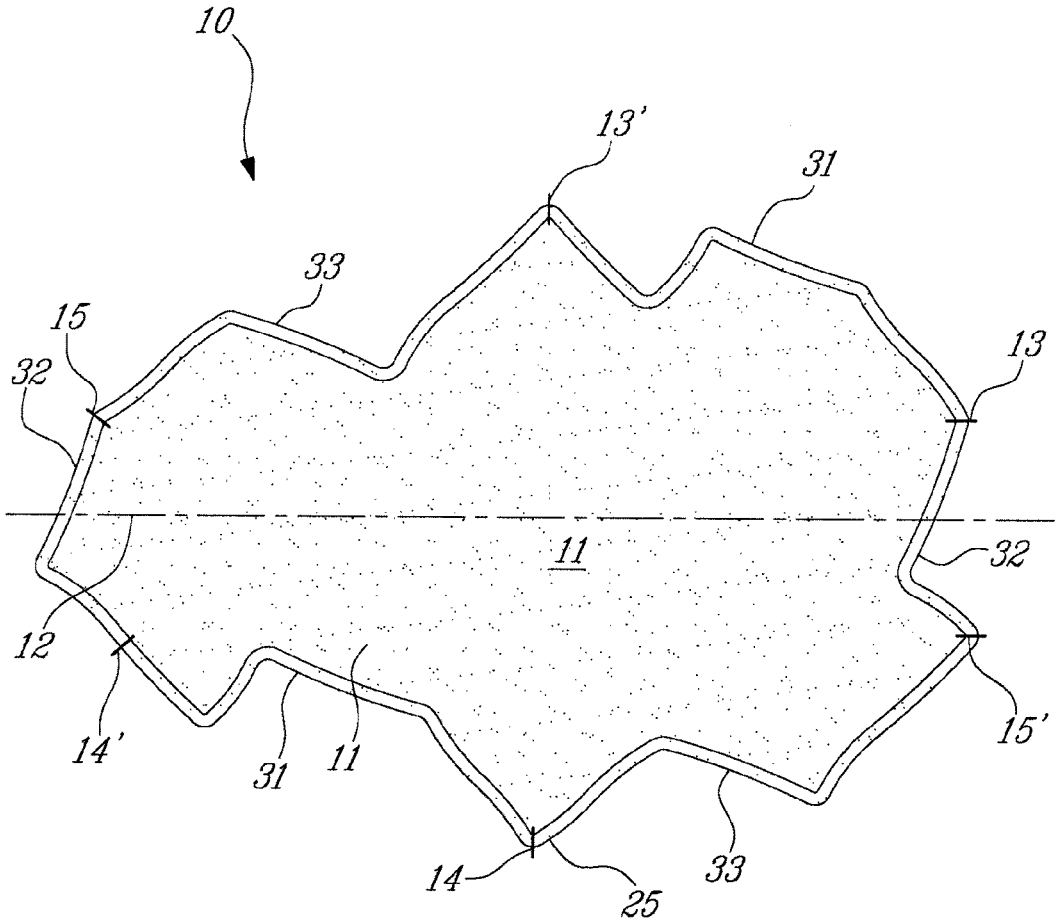
FIG. 1 is a top plan view of a paving stone constructed in accordance with the present application and illustrating its distinctive irregular contour pattern.

Referring to the drawings, and more particularly to FIG. 1, there is illustrated the paving stone 10 of the present disclosure. Paving stones are fabricated so as to have a body 11 peripherally defining the pattern of the paving stone 10. The periphery of the paving stone 10 of the present disclosure defines a jagged outline that is non-repetitive when contouring the paving stone 10. The paving stone 10 has projections and depressions of different shapes and different sizes (i.e., receiving cavities). Moreover, the paving stone 10 has a generally elongated shape with one end along its longitudinal axis 12 being smaller than the opposite end, resulting in a distinguishable orientation. This elongated shape facilitates the positioning of the paving stones in an interlocked herringbone arrangement, as well as in an interlocked linear arrangement, or in a combination thereof, as described hereinafter.

Figure 2:
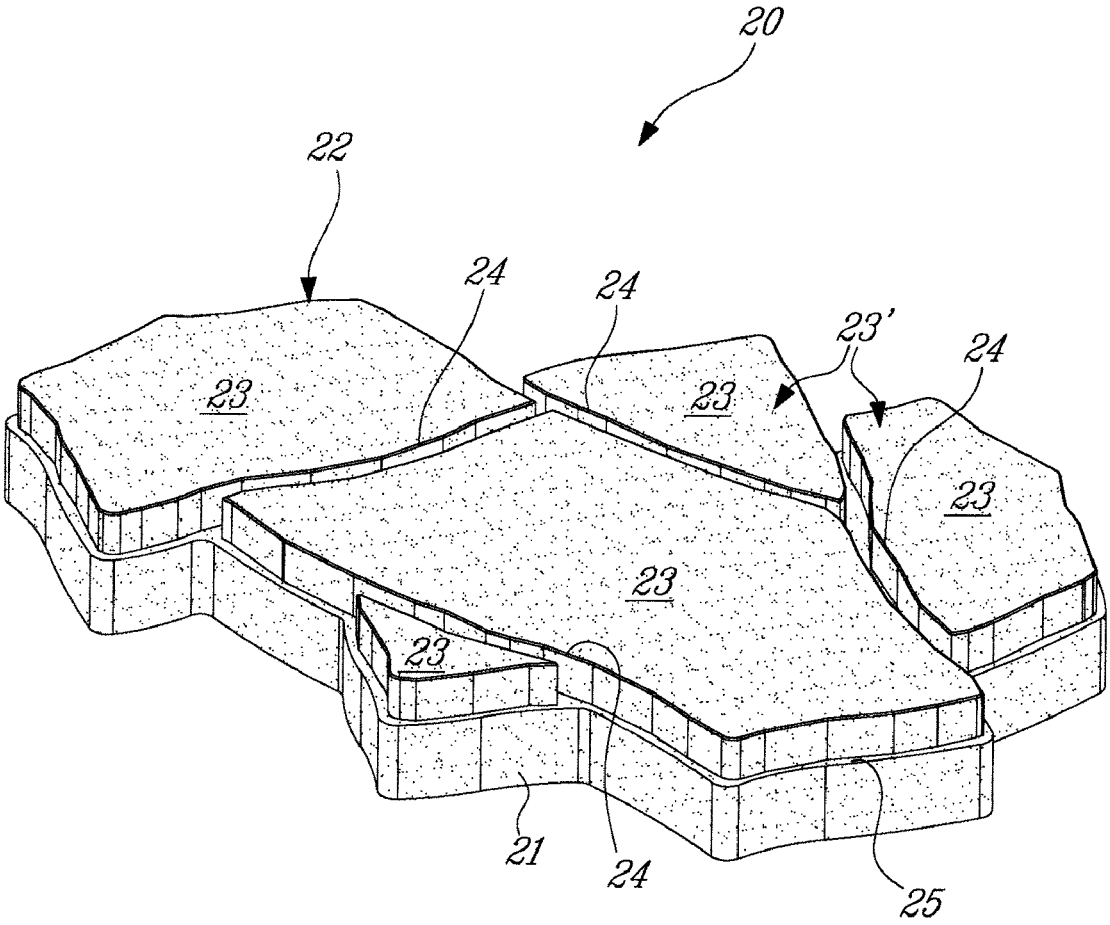
FIG. 2 is a perspective view of a paving stone with the contour pattern of FIG. 1, and wherein the top surface thereof is segmented into a variety of stone shapes.

Referring to FIG. 2, there is illustrated a pre-cast paving stone 20 having a body 21 which is the same as the paving stone 10 of FIG. 1, and with an exposed surface portion 22 projecting upwardly from the body 21. The long face of the body 21 is the interface of the paving stone 20 with the ground, or other surface upon which the paving stones will be laid out (e.g., it is possible to lay out the paving stones on edges to form a stone face wall). In an embodiment, the exposed surface portion 22 is the visible portion of the paving stone 10 when laid out. The paving stone 20 is a pre-cast concrete stone, and may have the exposed surface portion 22 formed with a plurality of smaller distinct substones 23 spaced apart to form joints therebetween to simulate a flagstone assembly. The exposed face 23' of the substones 23 may have a textured surface to simulate real stones. A shoulder 25 may be defined by the base 20, at the outer periphery of the exposed surface portion 22, to form joints with adjacent stones when the paving stones 10 are laid out. Alternatively, as is well known in the art, spacing formations can be cast at spaced intervals to form joints between adjacent stones when laid side-by-side. In the embodiment of the paving stone without the substones 23 and joints (e.g., FIG. 1), the shoulder 25 may be a slanted surface between the edge and the top surface of the paving stone 10. Accordingly, when the paving stone 10 of FIG. 1 is assembled with others, a contour joint is defined by the side-by-side shoulders 25.

In accordance with an embodiment, the paving stone 20 is pre-cast into a plurality of different models. Using the body 21 with the paving stone 10, the different sub-stones have patterns to define a different exposed surface portion. One method considered to pre-cast a plurality of different models is to use a casting cavity with the paving stone 10 (FIG. 1) to form the base of the paving stone 20 (FIG. 2), and with inserts to simulate the exposed portion 22 (FIG. 2). The inserts form the joints defining the substones 23, and the surface texture of the substones 23. Different pigments may be injected into the concrete mixture, to imitate discoloration and veins of real stones.

Figure 3:
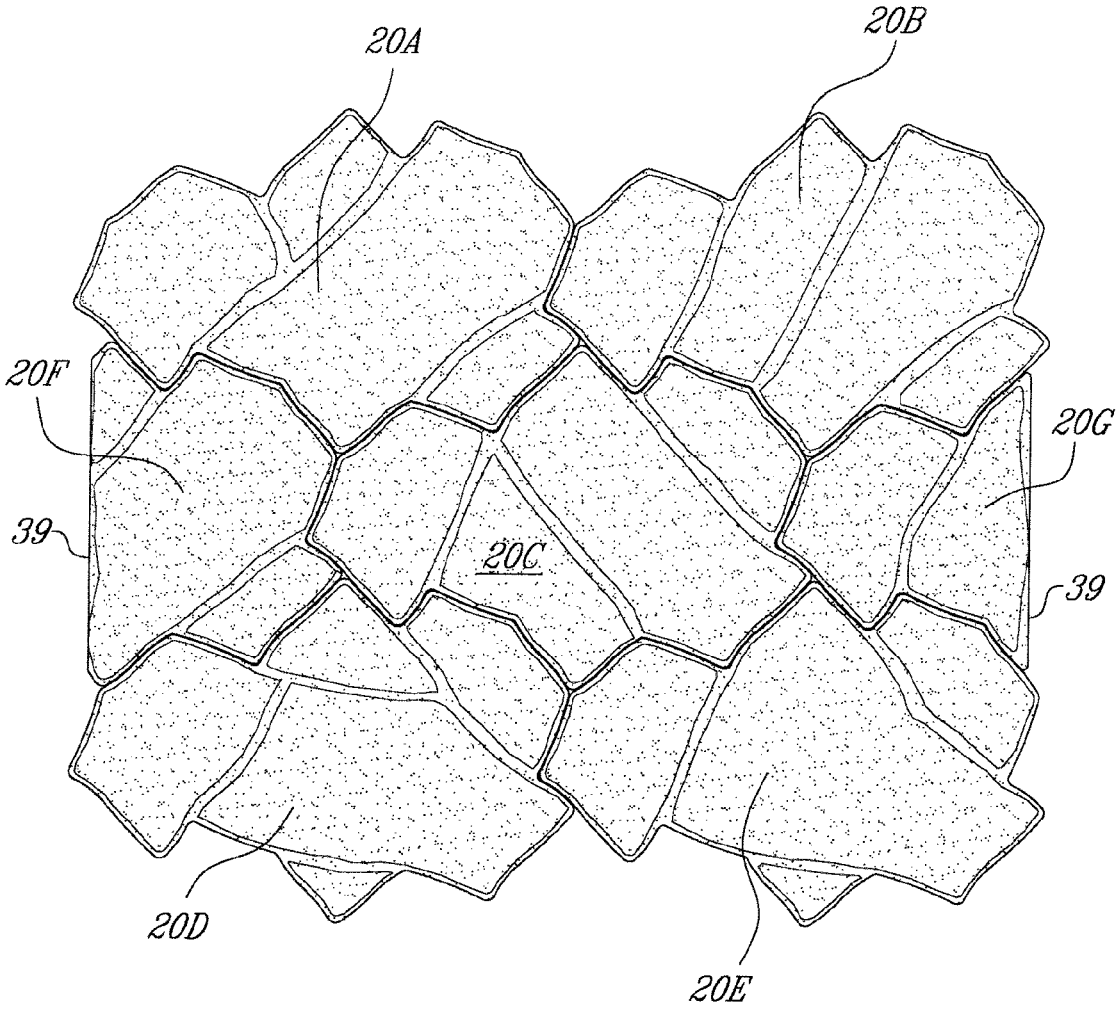
FIG. 3 is a top plan view of an assembly of a plurality of the paving stones of FIG. 2, as interlocked in a linear manner.

Referring to FIG. 3, a plurality of the paving stones with the paving stone 10 (FIG. 1) are illustrated as being assembled in a linear arrangement with their longitudinal axis 12 aligned. The paving stones are illustrated as 20A to 20E, with each of the paving stones 20A-20E having its own exposed portion 22. By the presence of different sets of sub-stones, for example six sets, the interlocking system of paving stones of FIG. 3 has a natural flagstone look, despite the fact that the system is made of pre-cast paving stones. The system may have more or less of the different sets of substones. However, in an embodiment, there are a sufficient amount of stones such that any paving stone 20 in a paving arrangement with multiple other paving stones 20 is preferably not interlocked with another paving stone 20 having the same set of substones.

Still referring to FIG. 3, there is illustrated a set of half paving stones 20F and 20G. The half paving stones 20F and 20G are precise parts of any one of the paving stones 20A-20E, but with a straight side 39, for instance for installation against a wall or a linear abutment, or to form a paved surface having a substantially straight edge outline. Straight edge outlines are desirable when laying a walkway, for instance. The half paving stones 20F-20G may be pre-cast by placing an insert in the casting cavity, thereby forming half of a paving stone. Alternatively, any of the paving stones 20A-20E may be cut to form a half paving stone, or a paving stone portion. This cut could also be made by the installer if there is a need to do so during installation.

Figure 4:
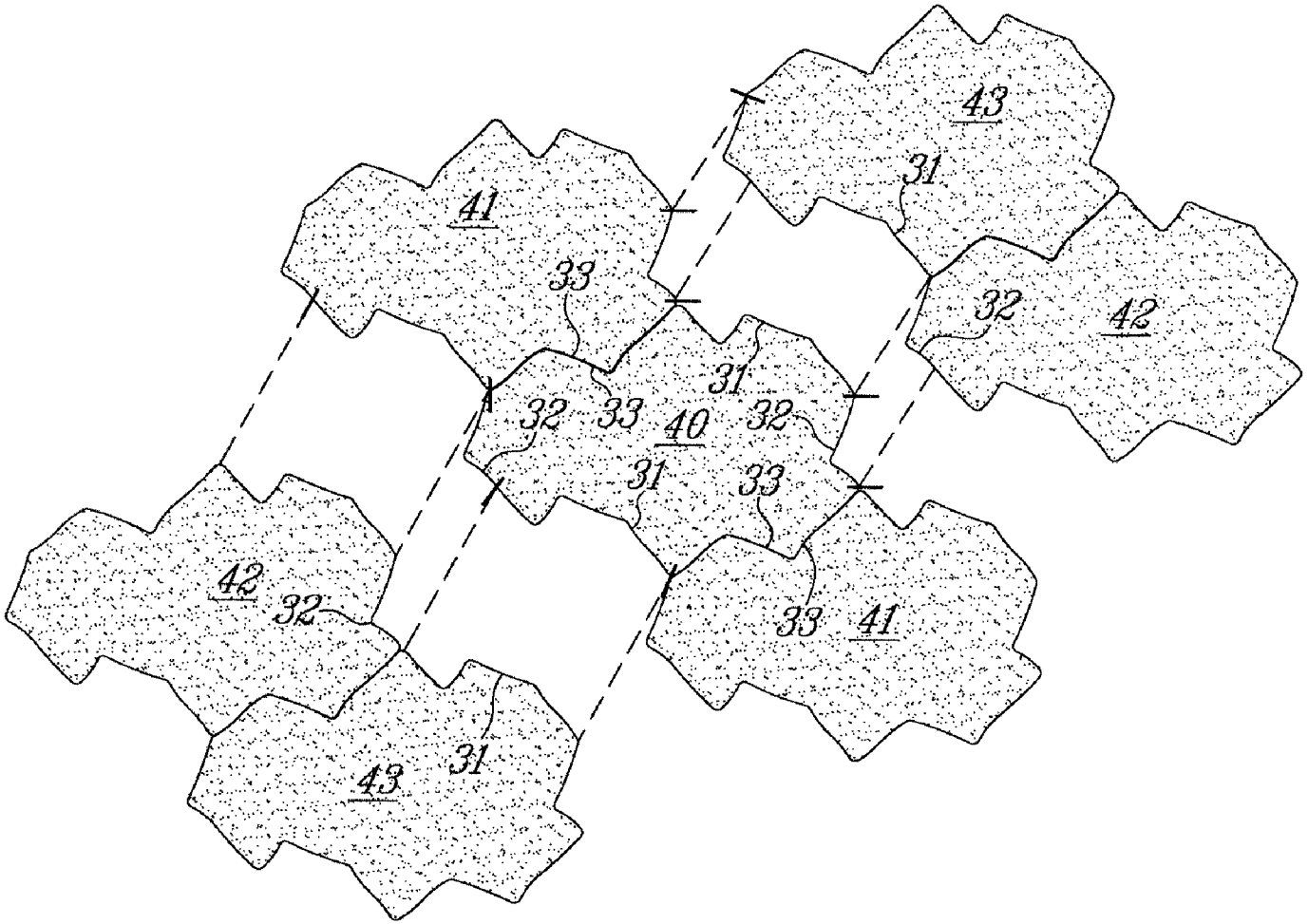
FIG. 4 is an exploded view illustrating the inter-relationship of the paving stones of FIG. 1 interlocked in the linear manner.

The paving stone 10 is defined to allow installation in both linear interlocking and herringbone interlocking. Referring to FIG. 4, the paving stones 10 are shown in an exploded view to illustrate their inter-relationship when constructing a linear interlocking assembly, as all stones 10 are all oriented in the same direction with their longitudinal axis 12 aligned in each row and parallel with adjacent rows.

The paving stone 10 of FIG. 1 allows the linear interlocking of an assembly of stones by a sequence of three pairs of dissimilar side sections. Looking at the paving stone 10 of FIG. 1, the paving stone 10 has a first pair of side sections 31 defined between the demarcation lines 13 and 13', and 14 and 14', a second pair of side sections 32 between demarcation lines 14' and 15, and 13 and 15', and a third pair of side sections 33 between demarcation lines 25 and 13', and 14 and 15'. The two side sections of a same pair are generally translated images of one another, and are on opposite sides of the paving stone 10, thereby defining interlocking profiles.

Accordingly, when paving stones 20 are installed side by side, with equivalent pairs being adjacent, the side sections interlock. This is schematically illustrated in FIG. 4, in a linear arrangement of the paving stones 20 of the present disclosure. For instance, paving stone 40 is placed side-by-side with paving stones 41, whereby side sections 33 interlock. Similarly, the paving stone 40 interlocks with paving stones 42, by interlocking of the side sections 32. Finally, the paving stone 40 interlocks with paving stones 43, by interlocking of side sections 31. Therefore, by matching equivalent pairs of side sections, a linear arrangement of the paving stones 20 (i.e., 40-44) is obtained, in which the elongated shapes of the six paving stones surrounding any given paving stone are parallel to the elongated shape of that given paving stone.

It is pointed out that the side sections of different pairs (e.g., side section 31 and side section 32) are different from one another. Moreover, the side sections 31 and 33 have depressions and projections, facilitating the interlocking between paving stones 20.

Figure 5:
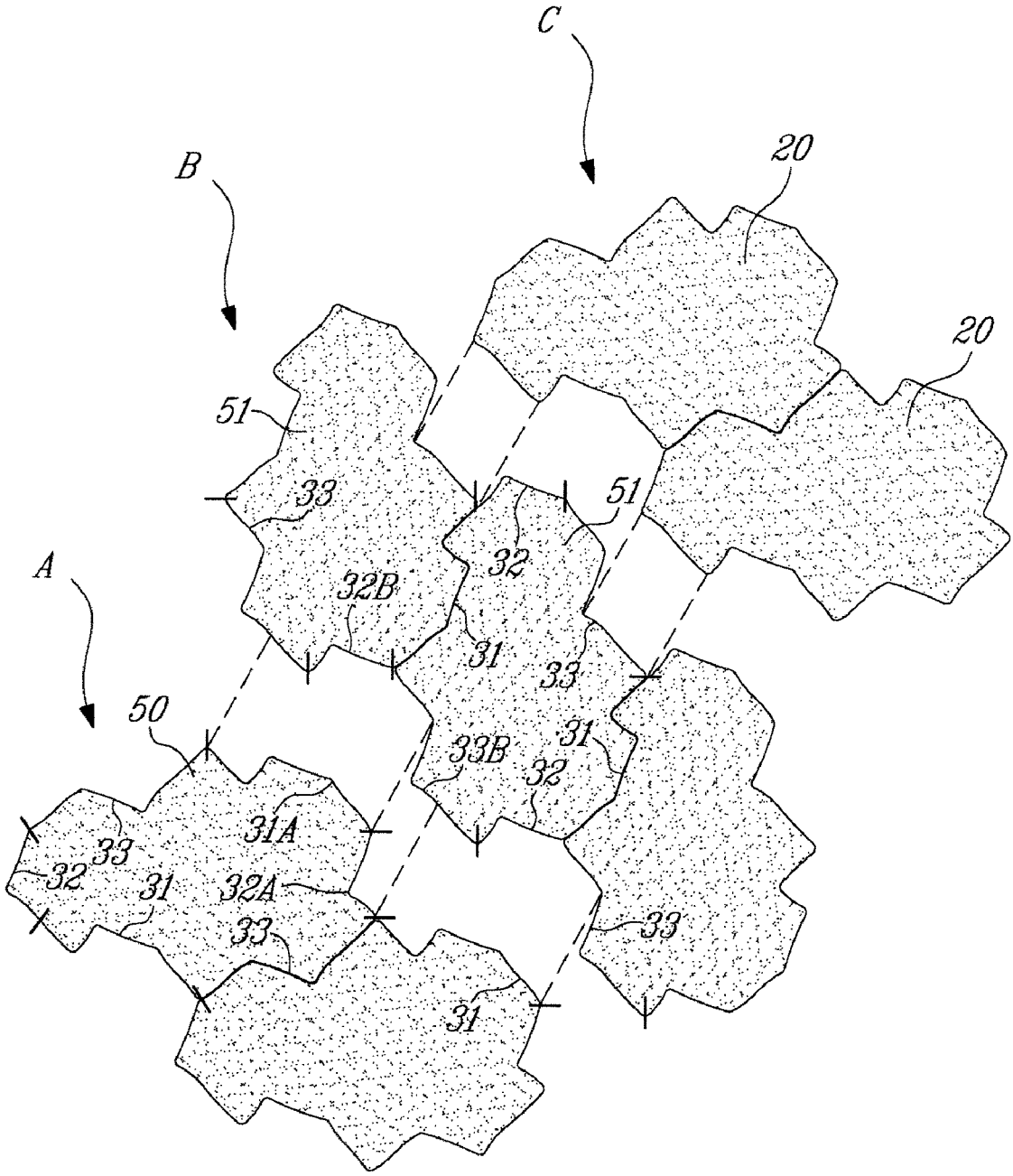
FIG. 5 is an exploded view illustrating the inter-relationship of the paving stones of FIG. 1 interlocked in a herringbone manner.

Referring to FIG. 5, the paving stones 20 may also be interlocked in a herringbone arrangement. This is achievable by the paving stone 10. More specifically, the pairs of side sections 31, 32 and 33 are configured such that the adjacent side sections 31A, 32A of the first pair and of the second pair of the paving stone 10 (e.g., illustrated as stone 50 for clarity), are an interlocking image of the adjacent combined side sections 32B, 33B of the second pair and of the third pair of two of the patterns 10 (e.g., illustrated as stones 51 for clarity). Accordingly, when a first row B is defined by interlocking the paving stones 51 by the first pair of side sections 31, and a second row A is defined by interlocking the paving stones 50 by the third pair of side sections 33, the first row B and the second row A are interlockable by the adjacent combined side sections 32B, 33B of the first row B interlocking with the adjacent side sections 31A, 32A of the second row A. This defines a herringbone arrangement of the paving stones 20, in which the elongated shapes of four paving stones surrounding any given paving stone are transverse to the elongated shape of the stone, whereas the elongated shapes of two paving stones surrounding that given paving stone are transverse to the elongated shape of that given paving stone.

Another row C is illustrated adjacent to the first row B, in view of being interlocked in the herringbone pattern. It is however pointed out that the paving stones 20 of row C may be oriented in a similar orientation as the paving stones of the first row B, for linear arrangement therebetween. In such a linear/herringbone arrangement, the elongated shapes of four paving stones surrounding any given paving stone are parallel to the elongated shape of that given paving stone, whereas the elongated shapes of two paving stones surrounding that given paving stone are parallel to the elongated shape of that given paving stone.

As all stones 20 have exposed surfaces 22 (FIGS. 2 and 3), the linear arrangements and herringbone arrangements are not visible from a top plan view when the paving stones 20 are laid out (e.g., FIG. 3). Accordingly, any combination of the linear and herringbone arrangements may be used, to enhance the natural flagstone look of a pavement with the paving stones 20.

In an embodiment, the side sections of any of the pairs 31, 32 and 33 may not be exact translated images of one another.

Accordingly, when the paving stones are laid out, the differences in shape of the side sections may result in joints of varying width between the substones 23 (FIGS. 2 and 3), enhancing the natural look of the assembly of paving stones 20.

The invention claimed is:

1. A concrete cast stone for use with other ones of said concrete cast stones for covering a surface, the concrete cast stone comprising an elongated shaped body having a longitudinal axis with said body tapering along said axis from opposed sides thereof to define a smaller tapering end resulting in a distinguishable orientation for said stone, said body having a peripheral contour of non-repetitive jagged shape for interlocking engagement of a plurality of the concrete cast stone, the peripheral contour having interlocking side sections and part-interlocking side sections such that said concrete cast stones placed side-by-side interlock by one or a combination of (1) matching the interlocking side sections in a linear arrangement of the concrete cast stones wherein the stones are aligned along their said longitudinal axis, and (2) matching some of the concrete cast stones with their said longitudinal axis transverse to said linear arrangement and partly interlocked with each other and said concrete cast stones of said linear arrangement to form a herringbone arrangement, said body having three pairs of side sections, with:

(a) the side sections of different pairs being different from one another, (b) the side sections of a same pair generally being translated images of one another and being on opposite sides of said longitudinal axis of the body to define interlocking profiles, such that said concrete cast stones placed side-by-side interlock by matching equivalent pairs of side sections in the linear arrangement of the concrete cast stones, and (c) the adjacent side sections of a first pair and of a second pair of one said concrete cast stone being an interlocking image of the adjacent combined side sections of the second pair and of a third pair of two said stones, such that when a first row is defined by interlocking said concrete cast stones by said first pair, and a second row is defined by interlocking said concrete cast stones by said third pair, the first row and the second row are interlockable by the adjacent combined side sections of the first row interlocking with the adjacent side sections of the second row in the herringbone arrangement of the concrete cast stones.

2. The concrete cast stone according to claim 1, further comprising an exposed surface portion defining one of a plurality of substone sets separated by joints to simulate a flagstone layout, the exposed surface portion projecting upwardly from the body.

3. The concrete cast stone according to claim 1, wherein the side sections of any one of the pairs being non-exact translated images of one another, such that a joint of varying width is defined between interlocked concrete cast stones.

4. The concrete cast stone according to claim 1, wherein the side sections of two of said pairs each comprise at least one receiving cavity and at least one projection.

5. The concrete cast stone according to claim 1, further comprising a third row of concrete cast stones, the third row being interlocked in a linear arrangement with the second row of concrete cast stones.

6. The concrete cast stone according to claim 1, further comprising a concrete cast stone portion pre-cast with an end surface perpendicular to a bottom of the body, thereby forming a straight edge surface when concrete cast stone portions are assembled at an end of one of the linear arrangement and the herringbone arrangement.

7. The concrete cast stone according to claim 1, further comprising a slanted surface defined between a top surface of the body and the peripheral contour.

8. The concrete cast stone according to claim 1, wherein a plurality of the concrete cast stone are used to cover a ground surface.

9. The concrete cast stone according to claim 1, wherein a plurality of the concrete cast stone are used to cover a vertical wall or portions thereof.

10. The method according to claim 1, wherein said body is formed by two half-stone sections, each half-stone section defining straight end edges extending transversely to said longitudinal axis to form a straight edge outline when assembled with other of said concrete cast stones, said half-stone sections having contrasting outlines.

11. The concrete cast stone according to claim 2, further comprising at least five of said substone sets, such that any one of the concrete cast stone on a surface is not adjacent to another of the concrete cast stone with the same substone set.

12. The concrete cast stone according to claim 2, further comprising a shoulder defined by a top surface of the body at a periphery of the exposed surface portion.

* * * * *

UNITED STATES PATENT AND TRADEMARK OFFICE

CERTIFICATE OF CORRECTION

PATENT NO. : 8,002,494 B2
APPLICATION NO. : 12/488660
DATED : August 23, 2011
INVENTOR(S) : Charles Ciccarello It is certified that error appears in the above-identified patent and that said Letters Patent is hereby corrected as shown below:

In the claims,

At column 6, line 33, claim 10 should read:

10. The concrete cast stone according to claim 1, wherein said body is formed by two half-stone sections, each half-stone section defining straight end edges extending transversely to said longitudinal axis to form a straight edge outline when assembled with other of said concrete cast stones, said half-stone sections having contrasting outlines.

Signed and Sealed this
Sixteenth Day of February, 2016

Michelle K. Lee

Michelle K. Lee
*Director of the United States Patent and Trademark Office*